US011426033B2

(12) United States Patent
Oberholzer

(10) Patent No.: US 11,426,033 B2
(45) Date of Patent: Aug. 30, 2022

(54) WASH STAND

(71) Applicant: GEBERIT INTERNATIONAL AG, Jona (CH)

(72) Inventor: Marco Oberholzer, Eschenbach (CH)

(73) Assignee: GEBERIT INTERNATIONAL AG, Jona (CH)

( * ) Notice: Subject to any disclaimer, the term of this patent is extended or adjusted under 35 U.S.C. 154(b) by 0 days.

(21) Appl. No.: 17/042,611

(22) PCT Filed: Mar. 28, 2019

(86) PCT No.: PCT/EP2019/057885
§ 371 (c)(1),
(2) Date: Sep. 28, 2020

(87) PCT Pub. No.: WO2019/185811
PCT Pub. Date: Oct. 3, 2019

(65) Prior Publication Data

US 2021/0015307 A1 Jan. 21, 2021

(30) Foreign Application Priority Data

Mar. 29, 2018 (EP) ..... 18164990
Mar. 29, 2018 (EP) ..... 18164992
(Continued)

(51) Int. Cl.
*A47K 1/04* (2006.01)
*E03C 1/14* (2006.01)

(52) U.S. Cl.
CPC . *A47K 1/04* (2013.01); *E03C 1/14* (2013.01)

(58) Field of Classification Search
CPC ..... E03C 1/14; E03C 1/16; E03C 1/18; E03C 1/182; E03C 1/22; E03C 1/32;
(Continued)

(56) References Cited

U.S. PATENT DOCUMENTS 2,241,194 A * 5/1941 Gavin ..... E03C 1/08 4/638
4,133,057 A * 1/1979 Rivetti ..... E03D 11/025 4/664
(Continued)

FOREIGN PATENT DOCUMENTS

DE 1 937 408 A1 2/1971
DE 31 52 007 A1 7/1983
(Continued)

OTHER PUBLICATIONS

International Search Report for PCT/EP2019/057885 dated Jun. 26, 2019 (PCT/ISA/210).

*Primary Examiner* — Janie M Loeppke
(74) *Attorney, Agent, or Firm* — Sughrue Mion, PLLC

(57) ABSTRACT

A wash stand assembly that comprises a wash stand having a wash basin and a drain opening through which water to be drained out of the wash basin can be conducted away, the drain opening leading into an inner chamber. The wash stand (2) has a rear wall (6) with which the wash stand (1) comes into contact with a connection structure on the building side when in the installed position. The inner chamber (5) is open in the region of a rear wall (6) of the wash stand (2). An insert element (7) has a drain connection piece (8) for connection to a wastewater pipe on the building side, wherein the insert element (7) is connected to the wash stand (2) such that the inner chamber (5) is sealed watertight and the water can be fed from the drain opening (4) to the drain connection piece (8).

34 Claims, 5 Drawing Sheets

(30) Foreign Application Priority Data

| | | |
|---|---|---|
| Mar. 29, 2018 | (EP) | 18164995 |
| May 16, 2018 | (EP) | 18172683 |
| May 16, 2018 | (EP) | 18172685 |
| Jul. 9, 2018 | (EP) | 18182527 |

(58) Field of Classification Search
CPC . E03C 1/322; E03C 1/33; E03C 1/335; A47K 1/04; A47K 1/12
See application file for complete search history.

(56) References Cited

U.S. PATENT DOCUMENTS

| | | | | |
|---|---|---|---|---|
| 5,625,909 | A * | 5/1997 | Ericson | E03C 1/14 4/619 |
| 10,234,333 | B2 * | 3/2019 | Dunn | E03C 1/2306 |
| 10,683,647 | B2 * | 6/2020 | Cullen | E03C 1/182 |

FOREIGN PATENT DOCUMENTS

| | | |
|---|---|---|
| DE | 20 2008 008 557 U1 | 11/2008 |
| DE | 10 2008 044 637 A1 | 10/2009 |
| EP | 1 288 379 A1 | 3/2003 |

* cited by examiner

WASH STAND

CROSS REFERENCE TO RELATED APPLICATIONS

This application is a National Stage of International Application No. PCT/EP2019/057885 filed Mar. 28, 2019, claiming priority based on European Patent Application No. 18 164 992.2 filed Mar. 29, 2018, Europe Patent Application No. 18 164 995.5 filed Mar. 29, 2018, European Patent Application No. 18 164 990.6 filed Mar. 29, 2018, European Patent Application No. 18 172 683.7 filed May 16, 2018, European Patent Application No. 18 172 685.2 filed May 16, 2018, and European Patent Application No. 18 182 527.4 filed Jul. 9, 2018.

TECHNICAL FIELD

The present invention relates to a washstand according to the preamble of claim 1.

PRIOR ART

Washstand systems with corresponding run-offs for the water have been disclosed by the prior art.

By way of example, DE 10 2008 044 637 discloses a washstand which can be connected to an outflow pipe. For this purpose, the washstand has a chamber into which the water flows. The chamber is then adjoined by the outflow pipe.

DE 10 2008 044 637 has two substantial drawbacks. On the one hand, the shaping of the washstand with the chamber can be produced only in a very costly manner. Various undercuts significantly increase the production outlay, particularly when the washstand is produced from ceramic. On the other hand, it is a drawback that the installation space required is comparatively large. This is in particular on account of the arrangement of the outflow pipe in the form of a pipe bend.

DE 20 2008 008 557 U1 has disclosed a further washstand, which has a connection piece which adjoins an outflow portion of the washstand and projects away substantially toward the rear.

SUMMARY OF THE INVENTION

Proceeding from said prior art, the present invention is based on the object of specifying a washstand which overcomes the drawbacks of the prior art. A particularly preferred object is to specify a washstand which can be produced in a more simple manner.

Said object is achieved by the subject matter of claim 1. Accordingly, a washstand assembly comprises a washstand having a water basin and a run-off opening, through which water to be discharged out of the water basin can be conducted away, wherein the run-off opening opens into an interior space which, as seen in the direction of flow of the water, preferably has a greater cross section than the run-off opening, wherein the wash stand has a rear wall with which the washstand, in the installation position, comes into contact with a building-side connection structure, and wherein, in the region of a rear wall of the washstand, the interior space is configured to be open. The connection structure is typically a wall in a bathroom or an assembly frame with a cladding. The washstand assembly further comprises an insert element having a run-off connector for connection to a building-side wastewater line, wherein the insert element is connected to the washstand in such a way that the interior space is tightly closed with respect to water, and that the water from the run-off opening can be fed to the run-off connector. In other words, the insert element is used as an element for conducting away the water which flows out of the run-off opening in the direction of the interior space.

As a result of the closure with the insert element, the shaping of the washstand in the region of the insert or the interior space, that is to say downstream of the run-off opening as seen in the direction of flow, can be improved from production-technology points of view. In particular, the arrangement of the insert element makes it possible for complex undercuts which are difficult to mold to be omitted. Accordingly, complex shaping and demolding of the washstand, as is known for example from the prior art, is omitted.

The insert element is configured in the form of a part separate from the washstand and can be connected to the washstand, as mentioned.

Preferably, the washstand is manufactured from ceramic and the insert element is manufactured from plastic.

The run-off connector preferably projects rearward away from the rear wall of the washstand. Preferably, the run-off connector extends away from the rear wall, in particular downward at a maximum angle of 10° in the installation position, that is to say from a horizontal plane.

Particularly preferably, the run-off connector is arranged in such a way that the run-off connector does not intersect a reference plane which extends at a right angle with respect to the rear wall and which extends through a lowermost edge of the rear wall. This means the run-off connector does not project out of a virtual border, which is defined by the side edges of the rear wall and which extends away at a right angle with respect to the rear wall. In this way, the compactness of the washstand assembly can be increased. The region below the washstand is also not obstructed by the run-off connector, which is advantageous for the arrangement of a piece of bathroom furniture.

Preferably, the insert element has a flange region, from which a wall which projects into the interior space protrudes. The outside of the wall is configured to substantially fit with the form of the interior space. The wall provides an outflow space or delimits the outflow space, which outflow space lies substantially in the interior space. The water coming from the run-off opening can be conducted away through the outflow space.

The expression "fit with the form" is understood to mean that the wall and the interior space are configured with respect to one another in such a way that the wall can be pushed into the interior space without colliding with the latter. Preferably, play is present between the wall and the interior space. In particular, a seal element, as described below, is arranged in said play.

The run-off connector preferably projects away out of the outflow space and penetrates the flange region in the cross section of the flange region. The run-off connector adjoins the outflow space.

Preferably, the run-off connector, as seen in the installation position, lies at the lowest location of the outflow space. This ensures that no residual water remains in the outflow space.

Preferably, the flange region completely surrounds the wall on the outside. This increases the stability of the insert element. Fastening points for the fastening of the insert element to the washstand are preferably arranged on the flange region. The rear wall preferably has a recess in which the flange region comes to lie. Particularly preferably, the recess is of sufficient depth so that the flange region does not project beyond the rear wall.

Preferably, the wall is at least partially configured in the form of a double wall with two mutually spaced-apart wall portions. The double wall preferably provides a reinforcement in such a way that, in the assembled state, the wall is clamped in the interior space on account of the reinforcement.

The insert element preferably has at least one sealing surface, on which there is arranged at least one seal element for interaction with the walls of the interior space and/or with the rear wall. The sealing surface serves substantially as a bearing surface or as a fastening surface for a seal element.

Preferably, the at least one seal element is a seal element which is configured separately from the insert element. This means that the seal element can be connected to the insert element. Alternatively, the at least one seal element is formed integrally on the insert element; for example by way of an injection-molding method.

The sealing surface is preferably provided by said wall, wherein the seal element is arranged at least in the region of an end side of the wall, wherein the seal element has a front-side sealing lip which substantially surrounds the run-off opening on the side of the interior space; and/or wherein the seal element is arranged in the region of an outer side of the wall and completely surrounds the wall in an encircling manner with at least one peripheral sealing lip.

Alternatively or additionally, the sealing surface is provided by said flange region. This means that the at least one seal element comes to lie between the flange region and the rear wall and/or the recess of the rear wall.

The combined provision of the sealing surface on the wall and on the flange region has the advantage that the seal element can be pulled up, starting from the wall, into the flange region. In this way, a plurality of seal lines can be provided.

Preferably, the insert element can be connected to the washstand by way of a materially bonded adhesive connection and/or a mechanical connection, wherein the mechanical connection is preferably a screw and dowel connection; and/or wherein the mechanical connection is preferably a clamping connection between the insert element and the interior space.

The adhesive connection has the advantage that, depending on the configuration, said connection can also serve as the seal element. The mechanical connection has the advantage that the latter is more typically releasable, as a result of which the insert element can be exchanged in the case of maintenance. The combined connection combines the two advantages.

Preferably, the run-off connector is arranged so as to be laterally offset with respect to the run-off opening, in particular in such a way that the run-off connector lies outside of a region which is formed by the clear width of the delimiting walls of the run-off opening in a viewing direction in the direction of the interior space. The run-off connector is thus in particular arranged in such a way that, when viewed as intended from the from side of the washstand, said connector is not visible as a result of a side wall which delimits the wash basin.

Preferably, the run-off opening penetrates a side wall of the water basin, wherein the run-off opening extends away from a bottom region of the wash basin in the direction of said side wall, and/or wherein the run-off opening, with respect to a transverse direction of the water basin, is arranged centrally in the side wall. In the case of the central arrangement, the run-off connector is then laterally offset with respect to said central arrangement.

Preferably, the insert element and/or the rear wall of the washstand has at least one coding element which is configured in such a way that incorrect installation of the insert element can be prevented. In particular, the run-off connector on the insert element is thus prevented from lying at an incorrect location.

Preferably, the coding element is provided by the recess on the rear wall of the washstand and the flange region of the insert element, and also by the wall which is arranged offset with respect to the flange region and by the interior space which is arranged offset with respect to the recess. In this way, the shaping makes it possible to provide a simple coding element.

Further embodiments are specified in the dependent claims.

BRIEF DESCRIPTION OF THE DRAWINGS

Preferred embodiments of the invention will be described below with reference to the drawings, which serve merely for explanation and are not to be interpreted as limiting. In the drawings.

DESCRIPTION OF PREFERRED EMBODIMENTS

Figure 1:
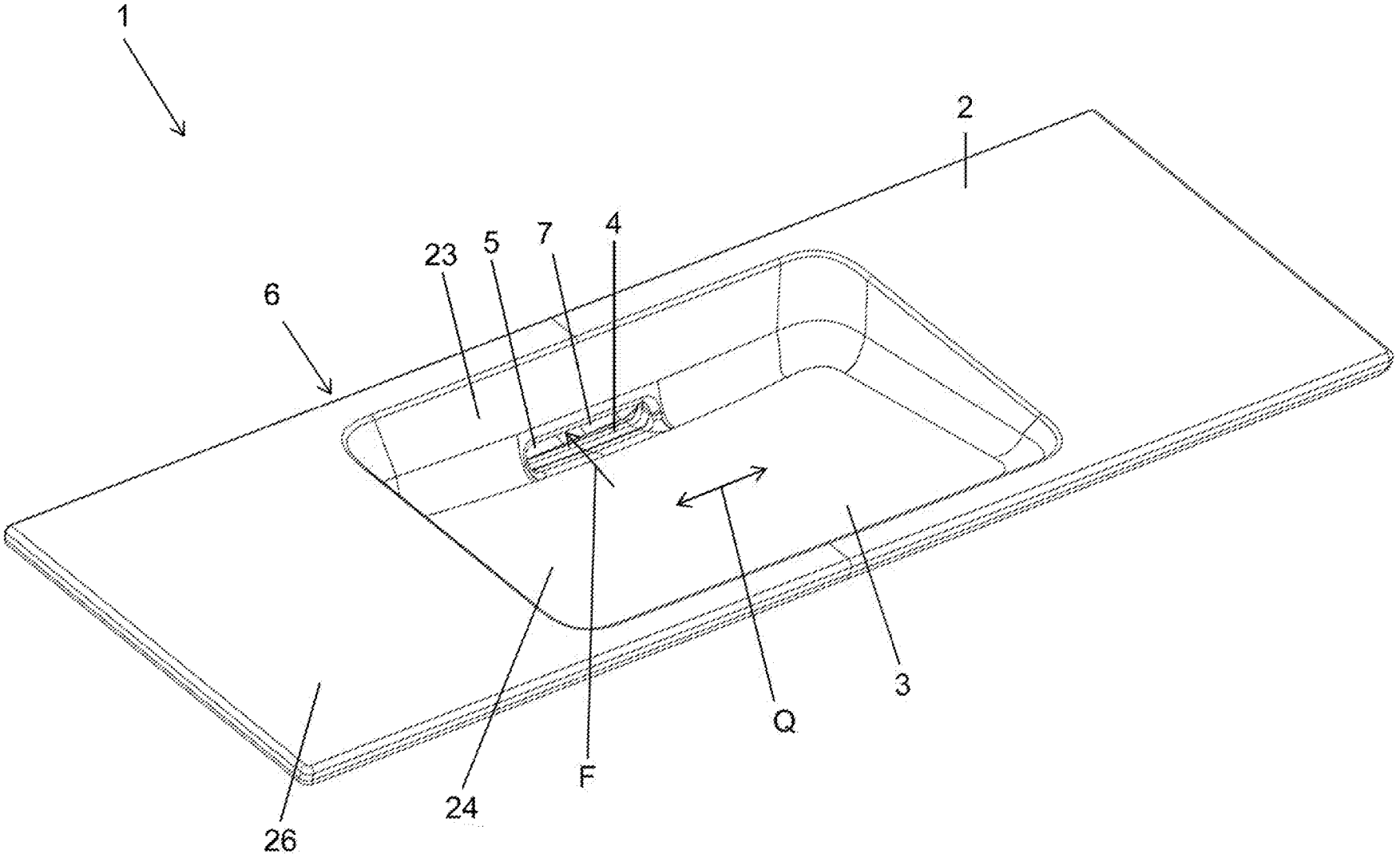
FIG. 1 shows a perspective front view of a washstand according to one embodiment of the present invention.

FIG. 1 shows a washstand assembly. The washstand assembly 1 substantially comprises a washstand 2 and an insert element 7, which can be connected to the washstand 2 in the region of the run-off.

The washstand 2 comprises a water basin 3 and a run-off opening 4, through which water to be discharged out of the water basin 3 can be conducted away. In the embodiment shown, the water basin 3 is delimited by a side wall 23 and a bottom region 24. Here, in the embodiment shown, the side wall 23 extends completely around the bottom region 24. Other embodiments are likewise conceivable. In the embodiment shown, the run-off opening lies in a rear side wall 23 and directly adjoins the bottom region 24. The side wall 24, at the upper side, adjoins an optional washstand surface 26.

Figure 2:
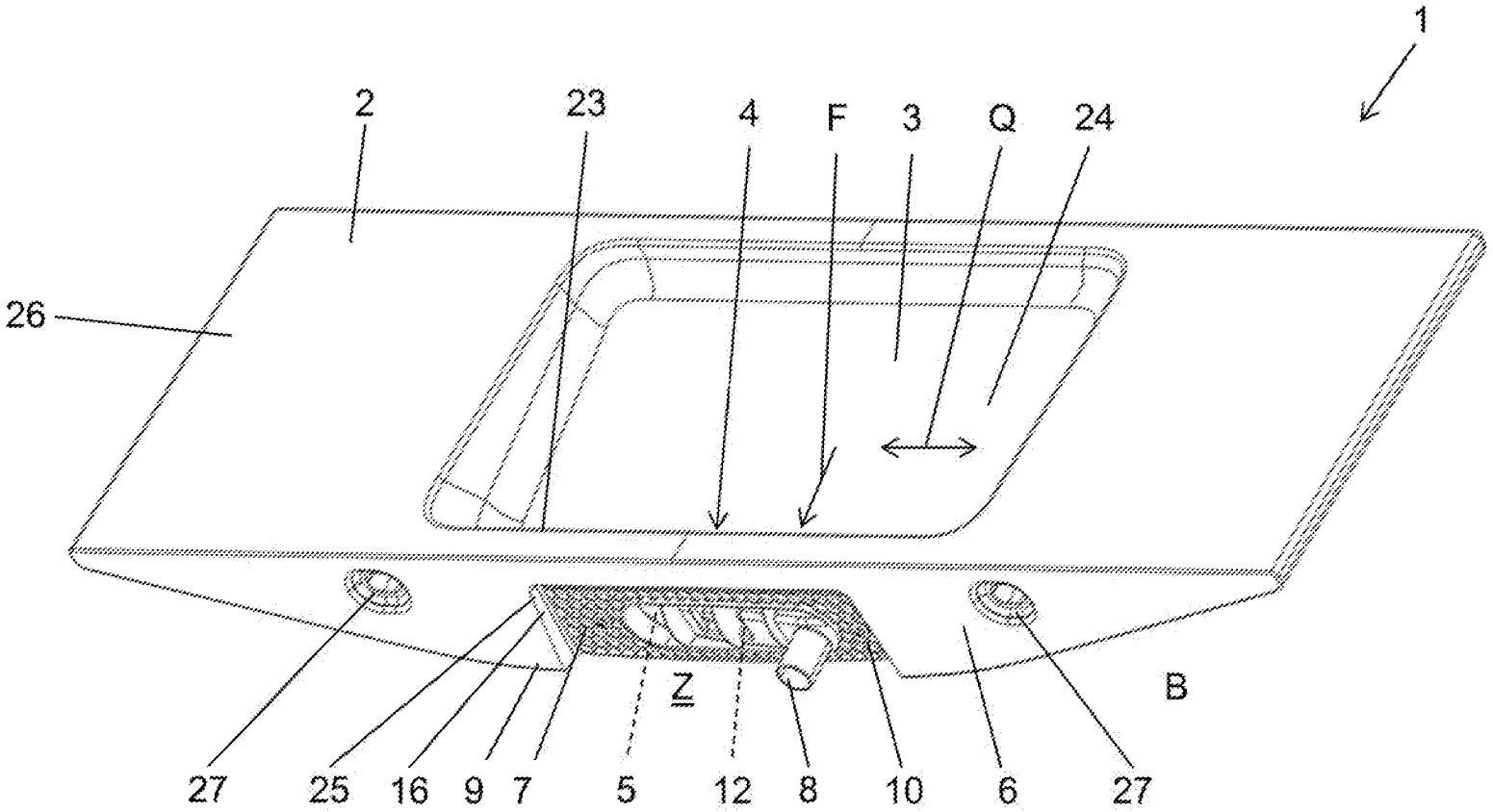
FIG. 2 shows a perspective rear view of the washstand according to FIG. 1.

FIG. 2 shows the washstand assembly 1 from the rear. The washstand furthermore comprises a rear wall 6, which can bear against a connection structure. The connection structure is for example a wall or an assembly frame or another similar structure. Furthermore, the washstand 2 has fastening openings 27 in the region of the rear wall 6. By way of said fastening opening 27, it is possible for the washstand 2 to be fixedly connected to the connection structure.

It can be readily recognized from FIG. 2 that the insert element 7 is arranged in the region of the rear wall 6. The insert element 7 comprises a run-off connector 8 for connection to a building-side wastewater line, which is not shown in the figures. The insert element 7 is preferably made of plastic and the washstand 2 is preferably made of ceramic.

Figure 3:
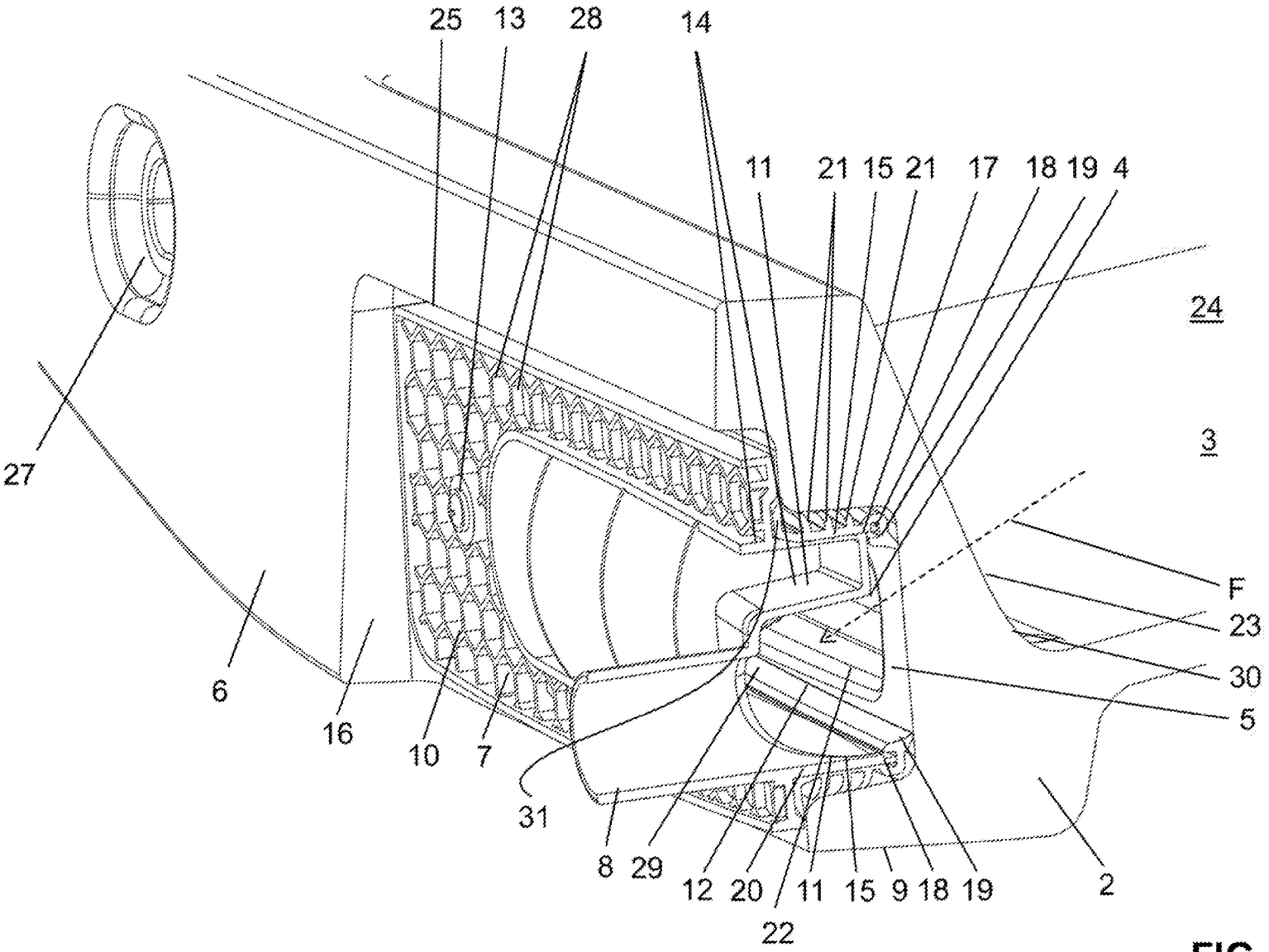
FIG. 3 shows a perspective sectional illustration through the washstand according to FIG. 1.

FIG. 3 shows a sectioned perspective view of the washstand assembly 1. The run-off opening 4 of the water basin 3 opens into an interior space 5, which is likewise part of the washstand 1 and which lies behind the side wall 23. The water flows along a direction of flow F through the opening 4 and into the interior space 5. The interior space 5 preferably has a greater cross section than the run-off opening 4. This means the interior space 5 widens correspondingly downstream of the run-off opening 4. In the region of the rear wall 6, the interior space 5 is configured to be open. This means the interior space 5 is accessible from the rear via the rear wall 6. The insert element 7 is in this case connected to the washstand 2 in such a way that the interior space 5 is tightly closed with respect to water. This means the insert element 7 is used to provide a type of water tank on the washstand 2, said tank receiving the water flowing through the run-off opening 4 and feeding it to the run-off connector 8. The arrangement of the insert element 7, which closes the interior space 5, has the advantage that the interior space 5 can be readily molded. The interior space 5 can in particular be formed without undercuts. Such undercuts would be necessary to correspondingly discharge the water. In the present case, the insert element 7 is substantially used to correspondingly discharge the water. This means that preferably all of the structures relating to the water flow downstream of the run-off opening 4, in other words in the interior space 5, are prescribed by the insert element 7.

Figure 4:
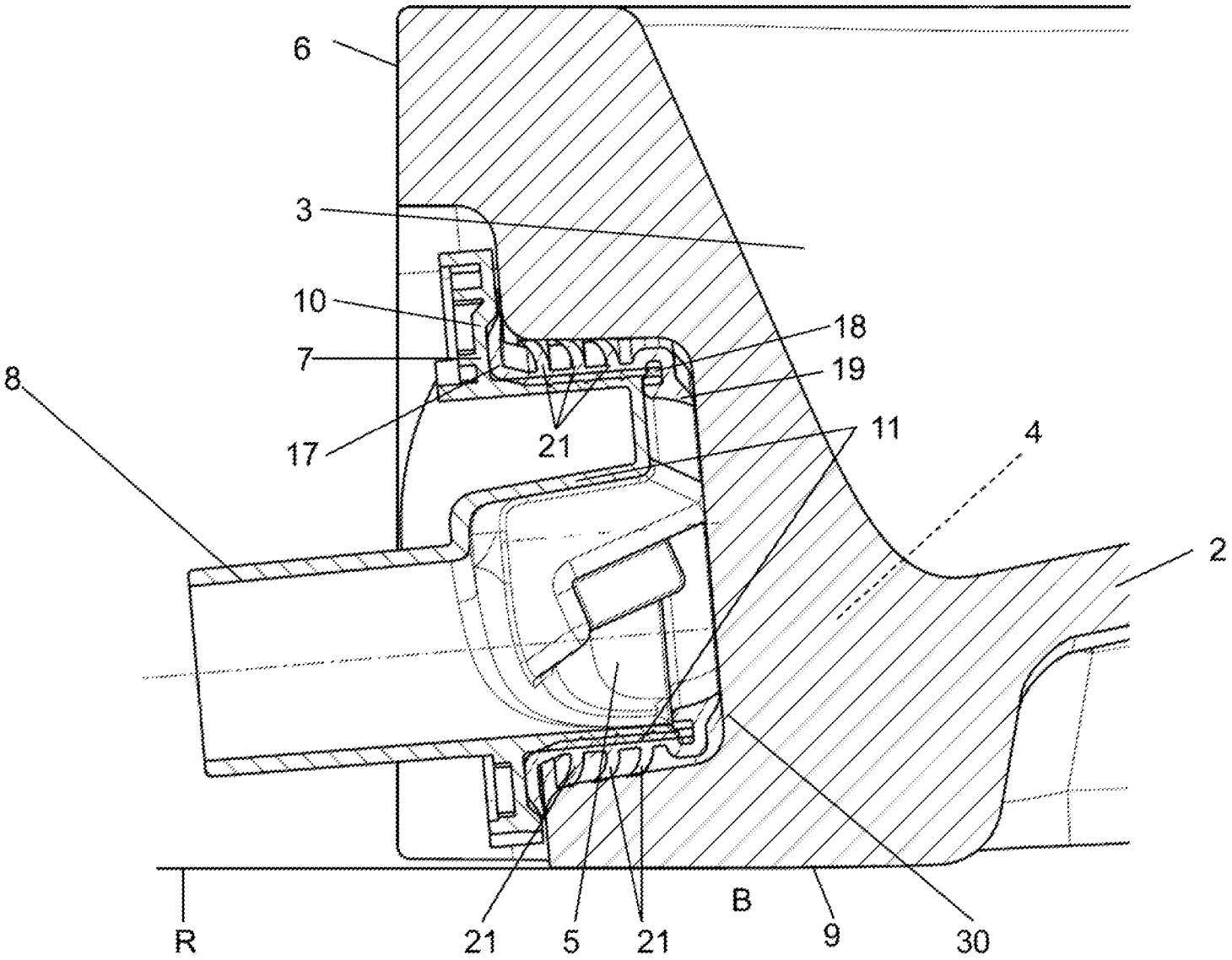
FIG. 4 shows a sectional illustration through the washstand according to FIG. 1.

The run-off connector 8 projects rearward away from the rear wall 6 of the washstand 2. This can be readily recognized from FIGS. 3 and 4. In this case, the run-off connector in particular projects away from the rear wall 6 of the washstand 2 in such a way that said connector does not intersect a reference plane R which extends at a right angle with respect to the rear wall 6 and which extends through the lower edge 9 of the rear wall 6. The reference plane R is depicted in FIG. 4. In other words, this means that the run-off connector 8 extends away from the rear wall 6 substantially horizontally or at a slight angle with respect to the horizontal. Said configuration has the advantage that the wastewater line on the wall side does not come to lie below the washstand 2. This means the region B below the reference plane R, or below the washstand 2 in general, is not adversely affected by the run-off connector 8 or elements connected thereto, such as a siphon, etc. Elements of this kind would then have to be arranged in the connection structure or the wall. Here, the user can make use of the full volume below the washstand for a piece of bathroom furniture, for example.

Figure 5:
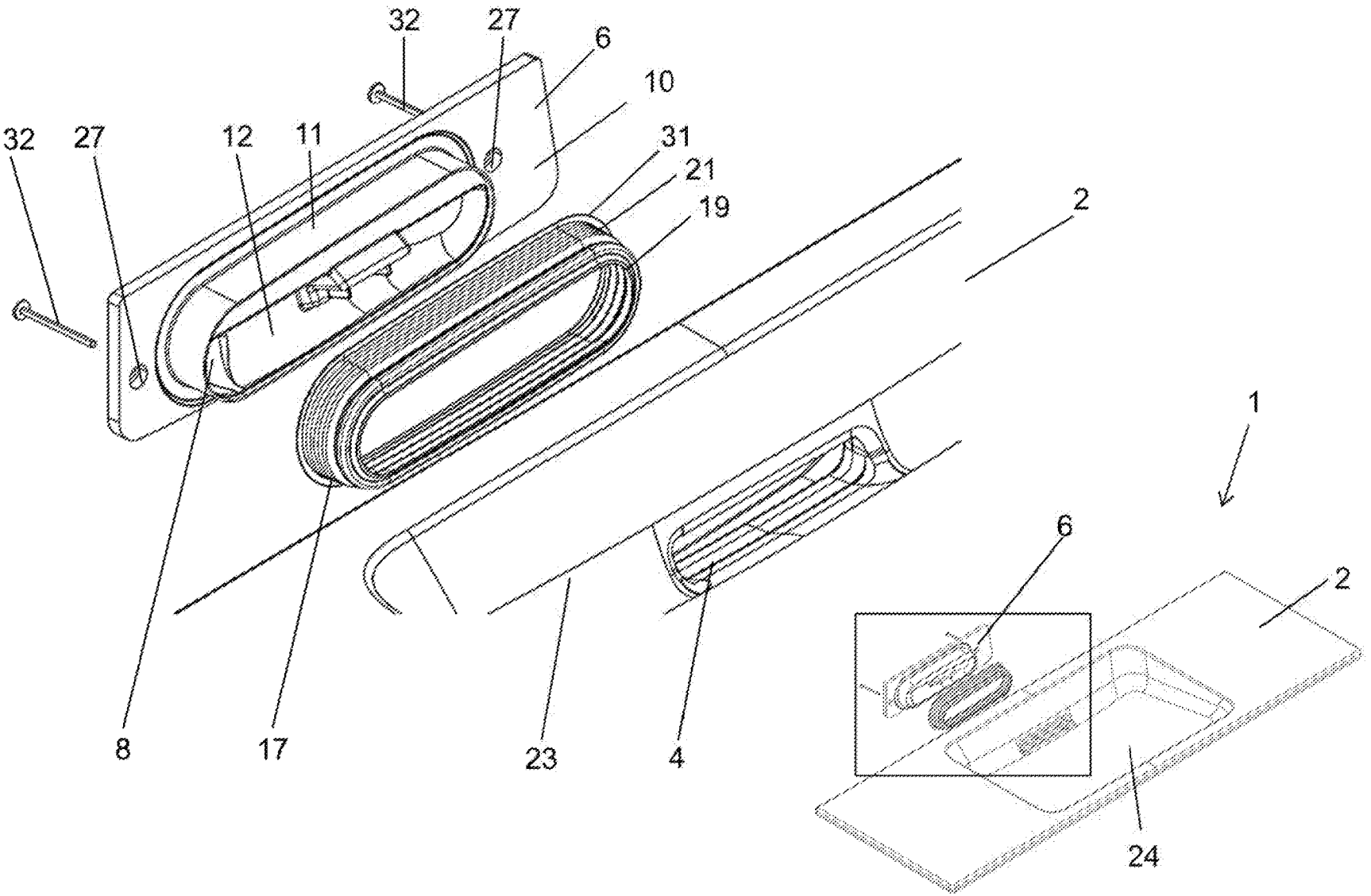
FIG. 5 shows a perspective exploded view of the washstand according to FIG. 1 with a detail view.

With reference to FIGS. 3 to 5, various features of the insert element 7 will now be explained in greater detail. The insert element 7 has a flange region 10, from which a wall 11 which projects into the interior space 5 protrudes. The outside of the wall 11 is in this case configured to fit with the form of the interior space 5, such that the wall 11 can be pushed into the interior space 5. The wall 11 delimits an outflow space 12, which then likewise lies substantially in the interior space 5. In this case, the outflow space 12 lies in such a way relative to the run-off opening 4 that the water flowing through the run-off opening 4 can flow into the outflow space 12. The run-off connector 8 in this case projects away out of the outflow space 12, as is illustrated in the two sectional illustrations. This means the water will flow away out of the outflow space 12 via the run-off connector 8. In this case, the run-off connector 8 substantially penetrates the flange region 10.

The flange region 10 has mechanical reinforcing structures 28 which, by way of example, are of honeycomb configuration here. Said mechanical reinforcing structures increase the stillness of the flange region 10.

The run-off connector 8, as seen in the installation position, lies at the lowest location of the outflow space 12. This ensures that the total amount of water which is fed to the outflow space can flow out of the outflow space 12. Preferably, as seen with respect to the horizontal, the lower region 29 of the outflow space 12 has a slight angular inclination, such that the water can be readily fed to the run-off connector 8 by way of said flow optimization.

The flange element 10 substantially completely surrounds the wall 11 on the outside. In other words, the wall 11 projects substantially from the flange region 10. The rear wall 6 has a recess 16 in which the flange region 10 comes to lie. This means the insert element 7 is arranged on the rear wall 6 in such a way that said element, with the exception of the run-off connector 8, does not extend beyond the rear wall 6, but rather is arranged in the washstand 3 in a sunken manner with respect to the rear wall 6. At least in certain portions, the wall 11 is at least partially configured in the form of a double wall with two mutually spaced-apart wall portions 14. This is correspondingly shown in FIGS. 3 and 4. During assembly, the two mutually spaced-apart wall portions 14 are deformed slightly relative to one another, and therefore the double wall provides a spring action. In this case, the spring action is such that the wall 11, in the assembled state, is lightly clamped in the interior space 5 on account of the spring action.

Furthermore, the insert element 7 has at least one sealing surface 15. On the sealing surface 15, there is arranged a seal element 17 for interaction with the walls of the interior space 5 and/or with the rear wall 6. In the embodiment shown, the sealing surface 15 is arranged on the outer side of the wall 11 and extends slightly into the flange region 11. In this case, various sealing lips 19, 21 and 31 are arranged.

A first sealing lip 19 is positioned on the end side 18 of the wall 11 and extends in the direction of the run-off opening 4. The sealing lip 19 is used to provide a gap between the end side 18 of the insert element 7 and a mouth area 30 which borders the run-off opening 4 on the side of the interior space 5.

In the embodiment shown, further sealing lips 21 are arranged. Here, three sealing lips 21 are arranged which can be referred to as peripheral sealing lips 21. Said peripheral sealing lips 21 extend around the outflow space 12 in a completely encircling manner on the outer side 20 of the wall 11. In this case, the peripheral sealing lips 21 interact with the corresponding wall of the interior space 5. It is also possible for more, or fewer, than three sealing lips 21 to be arranged. If the wall 11 is partially configured in the form of a double wall, the double wall has the additional effect that a force is exerted on the peripheral sealing lips 21, such that the latter are constantly pressed against the interior space 5.

A further sealing lip 31 is arranged here in the region of the flange region 10. In this case, the further sealing lip 31 is directed against the surface of the recess 16.

In other embodiments, it would also be possible to omit at least one of the sealing lips 19, 21 or 31.

In the embodiment shown, the seal element 17 is provided in the form of a seal element which is configured separately from the insert element 7. Alternatively, however, the seal element 17 can also be formed integrally on the insert element 7, for example by way of an injection-molding method. The configuration of the seal element separately from the insert element 7 is correspondingly shown in FIG. 5, the seal element 7 is illustrated at a spacing from the insert element 7 here.

As can be readily recognized from all of the figures, the run-off connector 8 is arranged so as to be laterally offset with respect to the run-off opening 4. In this case, the run-off connector 8 is in particular arranged in such a way that the run-off connector 8 lies outside of a region which is formed by the clear width of the delimiting walls 22 of the run-off opening 4 in a viewing direction in the direction of the interior space 5. This means that, as viewed from the from in the use position, the run-off connector 8 is substantially not visible. If the run-off opening 4, with respect to a transverse direction Q of the water basin 3, is arranged centrally in the side wall 23, the lateral offset of the run-off connector 8 with respect to the run-off opening 4 has the further advantage that the run-off connector 8 is on the whole arranged so as to be laterally offset with respect to the washstand 2. In this way, a free region Z is provided, which is illustrated in FIG. 2. Water lines to the outlet fittings arranged on the washstand or in the connection structure can be conducted through said free region Z.

Furthermore, the insert element 8 or the rear wall 6 of the washstand 2 has at least one coding element 25. The coding element 25 is configured in such a way that incorrect installation of the insert element 7 can be prevented. The coding element 25 can have various forms. In the embodiment shown, the coding element 25 is provided substantially by the recess 16 on the rear wall of the washstand 2 and the flange region 10 of the insert element 7. It can be readily recognized from FIG. 5 that the wall 11 is arranged so as to be laterally offset with respect to the flange region 10. Equally, the interior space 5 is likewise arranged so as to be laterally offset with respect to the recess 16. In this way, it is possible to prevent the insert element 7 from being able to be installed incorrectly. The insert element 7 is preferably connected to the washstand 2 by way of a mechanical connection and/or a materially bonded connection.

In the embodiment shown, a mechanical connection is shown. For this purpose, the flange portion 10 has fastening openings 27, through which screws 32 can be guided. In this case, the screws 32 preferably engage in dowels which are connected to the washstand 2. The dowels are not shown in the figures.

In the case of a materially bonded connection, it would be conceivable for a zone for an adhesive-material layer to be arranged on the flange region 10. In this case, the insert element 7 is then adhesively bonded to the recess 16, for example. Such an adhesive layer could also simultaneously act as a sealing layer.

| LIST OF REFERENCE SIGNS | |
|---|---|
| 1 | Washstand assembly |
| 2 | Washstand |
| 3 | Water basin |
| 4 | Run-off opening |
| 5 | Interior space |
| 6 | Rear wall |
| 7 | Insert element |
| 8 | Run-off connector |
| 9 | Lowermost edge |
| 10 | Flange region |
| 11 | Wall |
| 12 | Outflow space |
| 13 | Fastening points |
| 14 | Wall portion |
| 15 | Sealing surface |
| 16 | Recess |
| 17 | Seal element |
| 18 | End side |
| 19 | Sealing lip |

-continued

| LIST OF REFERENCE SIGNS | |
|---|---|
| 20 | Outer side |
| 21 | Peripheral sealing lip |
| 22 | Delimiting wall |
| 23 | Side wall |
| 24 | Bottom region |
| 25 | Coding element |
| 26 | Washstand surface |
| 27 | Fastening openings |
| 28 | Mechanical reinforcing structures |
| 29 | Lower region |
| 30 | Mouth area |
| 31 | Further sealing lip |
| 32 | Screws |
| B | Region |
| F | Direction of flow |
| Q | Transverse direction |
| Z | Free region |
| R | Reference plane |

The invention claimed is:

1. A washstand assembly comprising:

a washstand having a water basin and a run-off opening, through which water to be discharged out of the water basin can be conducted away;

wherein the run-off opening opens into an interior space, wherein the washstand has a rear wall with which the washstand, in the installation position, comes into contact with a building-side connection structure, and wherein, in the region of the rear wall of the washstand, the interior space is configured to be open; and an insert element having a run-off connector for connection to a building-side wastewater line, wherein the insert element is connected to the washstand in such a way that the interior space is tightly closed with respect to water, and that the water from the run-off opening can be fed to the run-off connector, wherein the insert element has a flange region, from which a wall which projects into the interior space protrudes, wherein the outside of the wall is configured to fit with the form of the interior space, and wherein the wall provides an outflow space which lies substantially in the interior space, wherein the run-off connector is arranged so as to be laterally offset with respect to the run-off opening in such a way that the run-off connector lies outside of a region which is formed by a clear width of a delimiting walls of the run-off opening in a viewing direction in the direction of the interior space, and wherein the flange region completely surrounds the wall on the outside and comprises fastening points for the fastening of the insert element to the washstand.

2. The washstand assembly as claimed in claim 1, wherein the interior space, as seen in the direction of flow of the water, has a greater cross section than the run-off opening.

3. The washstand assembly as claimed in claim 1, wherein the run-off connector projects rearward away from the rear wall of the washstand.

4. The washstand assembly as claimed in claim 3, wherein the insert element and/or the rear wall of the washstand has at least one coding element which is configured in such a way that incorrect installation of the insert element can be prevented, wherein the insert element has a flange region, from which a wall which projects into the interior space protrudes, wherein the outside of the wall is configured to fit with the form of the interior space and wherein the wall provides an outflow space which lies substantially in the interior space and wherein the coding element is provided by the recess on the rear wall of the washstand and the flange region of the insert element, and also by the wall which is arranged offset with respect to the flange region and by the interior space which is arranged offset with respect to the recess.

5. The washstand assembly as claimed in claim 1, wherein the run-off connector is arranged in such a way that the run-off connector does not fall below or intersect a reference plane which extends at a right angle with respect to the rear wall and which extends through a lowermost edge of the rear wall.

6. The washstand assembly as claimed in claim 5, wherein the insert element and/or the rear wall of the washstand has at least one coding element which is configured in such a way that incorrect installation of the insert element can be prevented, wherein the insert element has a flange region, from which a wall which projects into the interior space protrudes, wherein the outside of the wall is configured to fit with the form of the interior space and wherein the wall provides an outflow space which lies substantially in the interior space and wherein the coding element is provided by the recess on the rear wall of the washstand and the flange region of the insert element, and also by the wall which is arranged offset with respect to the flange region and by the interior space which is arranged offset with respect to the recess.

7. The washstand assembly as claimed in claim 1, wherein the run-off connector projects away out of the outflow space and penetrates the flange region in the cross section of the flange region, and/or wherein the run-off connector, as seen in the installation position, lies at the lowest location of the outflow space, and/or wherein the rear wall has a recess in which the flange region comes to lie.

8. The washstand assembly as claimed in claim 1, wherein the wall is at least partially configured in the form of a double wall with two mutually spaced-apart wall portions, which double wall provides a reinforcement in such a way that, in the assembled state, the wall is clamped in the interior space on account of the reinforcement.

9. The washstand assembly as claimed in claim 1, wherein the insert element has at least one sealing surface, on which there is arranged at least one seal element for interaction with the walls of the interior space and/or with the rear wall.

10. The washstand assembly as claimed in claim 9, wherein the at least one seal element is a seal element which is configured separately from the insert element; and/or wherein the at least one seal element is formed integrally on the insert element.

11. The washstand assembly as claimed in claim 9, wherein the sealing surface is provided by said wall, wherein the seal element is arranged at least in the region of an end side of the wall, wherein the seal element has a front-side sealing lip which substantially surrounds the run-off opening on the side of the interior space, and/or wherein the seal element is arranged in the region of an outer side of the wall and completely surrounds the wall in an encircling manner with at least one peripheral sealing lip.

12. The washstand assembly as claimed in claim 9, wherein the sealing surface is provided by said flange region, wherein the at least one seal element comes to lie between the flange region and the rear wall and/or the recess of the rear wall.

13. The washstand assembly as claimed in claim 1, wherein the insert element can be connected to the washstand by way of a materially bonded adhesive connection and/or a mechanical connection.

14. The washstand assembly as claimed in claim 13, wherein the mechanical connection is a screw and dowel connection; or wherein the mechanical connection is a clamping connection between the insert element and the interior space.

15. The washstand assembly as claimed in claim 1, wherein the run-off opening penetrates a side wall of the water basin, wherein the run-off opening extends away from a bottom region of the wash basin in the direction of said side wall, and/or wherein the run-off opening, with respect to a transverse direction of the water basin, is arranged centrally in the side wall.

16. The washstand assembly as claimed in claim 1, wherein the insert element and/or the rear wall of the washstand has at least one coding element which is configured in such a way that incorrect installation of the insert element can be prevented.

17. The washstand assembly as claimed in claim 1, wherein the insert element and/or the rear wall of the washstand has at least one coding element which is configured in such a way that incorrect installation of the insert element can be prevented, wherein the insert element has a flange region, from which a wall which projects into the interior space protrudes, wherein the outside of the wall is configured to fit with the form of the interior space and wherein the wall provides an outflow space which lies substantially in the interior space and wherein the coding element is provided by the recess on the rear wall of the washstand and the flange region of the insert element, and also by the wall which is arranged offset with respect to the flange region and by the interior space which is arranged offset with respect to the recess.

18. A washstand assembly comprising:

a washstand having a water basin and a run-off opening, through which water to be discharged out of the water basin can be conducted away;

wherein the run-off opening opens into an interior space, wherein the washstand has a rear wall with which the washstand, in the installation position, comes into contact with a building-side connection structure, and wherein, in the region of the rear wall of the washstand, the interior space is configured to be open; and an insert element having a run-off connector for connection to a building-side wastewater line, wherein the insert element is connected to the washstand in such a way that the interior space is tightly closed with respect to water, and that the water from the run-off opening can be fed to the run-off connector, wherein the insert element has a flange region, from which a wall that projects into the interior space protrudes, wherein the outside of the wall is configured to fit with the form of the interior space, and wherein the wall provides an outflow space which lies substantially in the interior space, wherein the wall has two flat portions which are arranged opposite to each other and two rounded portions which connect the two flat portions, and wherein the run-off connector is arranged so as to be laterally offset with respect to the run-off opening in such a way that the run-off connector lies outside of a region which is formed by a clear width of a delimiting wall of the run-off opening in a viewing direction in the direction of the interior space.

19. The washstand assembly as claimed in claim 18, wherein the interior space, as seen in the direction of flow of the water, has a greater cross section than the run-off opening.

20. The washstand assembly as claimed in claim 18, wherein the run-off connector projects rearward away from the rear wall of the washstand.

21. The washstand assembly as claimed in claim 20, wherein the insert element and/or the rear wall of the washstand has at least one coding element which is configured in such a way that incorrect installation of the insert element can be prevented, wherein the insert element has a flange region, from which a wall which projects into the interior space protrudes, wherein the outside of the wall is configured to fit with the form of the interior space and wherein the wall provides an outflow space which lies substantially in the interior space, and wherein the coding element is provided by the recess on the rear wall of the washstand and the flange region of the insert element, and also by the wall which is arranged offset with respect to the flange region and by the interior space which is arranged offset with respect to the recess.

22. The washstand assembly as claimed in claim 18, wherein the run-off connector is arranged in such a way that the run-off connector does not fall below or intersect a reference plane which extends at a right angle with respect to the rear wall and which extends through a lowermost edge of the rear wall.

23. The washstand assembly as claimed in claim 22, wherein the insert element and/or the rear wall of the washstand has at least one coding element which is configured in such a way that incorrect installation of the insert element can be prevented, wherein the insert element has a flange region, from which a wall which projects into the interior space protrudes, wherein the outside of the wall is configured to fit with the form of the interior space and wherein the wall provides an outflow space which lies substantially in the interior space, and wherein the coding element is provided by the recess on the rear wall of the washstand and the flange region of the insert element, and also by the wall which is arranged offset with respect to the flange region and by the interior space which is arranged offset with respect to the recess.

24. The washstand assembly as claimed in claim 18, wherein the run-off connector projects away out of the outflow space and penetrates the flange region in the cross section of the flange region, and/or wherein the run-off connector, as seen in the installation position, lies at the lowest location of the outflow space, and/or wherein the flange region completely surrounds the wall on the outside and comprises fastening points for the fastening of the insert element to the washstand, and/or wherein the rear wall has a recess in which the flange region comes to lie.

25. The washstand assembly as claimed in claim 24, wherein the insert element and/or the rear wall of the washstand has at least one coding element which is configured in such a way that incorrect installation of the insert element can be prevented, wherein the insert element has a flange region, from which a wall which projects into the interior space protrudes, wherein the outside of the wall is configured to fit with the form of the interior space and wherein the wall provides an outflow space which lies substantially in the interior space, and wherein the coding element is provided by the recess on the rear wall of the washstand and the flange region of the insert element, and also by the wall which is arranged offset with respect to the flange region and by the interior space which is arranged offset with respect to the recess.

26. The washstand assembly as claimed in claim 18, wherein the wall is at least partially configured in the form of a double wall with two mutually spaced-apart wall portions, which double wall provides a reinforcement in such a way that, in the assembled state, the wall is clamped in the interior space on account of the reinforcement.

27. The washstand assembly as claimed in claim 18, wherein the insert element has at least one sealing surface, on which there is arranged at least one seal element for interaction with the walls of the interior space and/or with the rear wall.

28. The washstand assembly as claimed in claim 27, wherein the at least one seal element is a seal element which is configured separately from the insert element; and/or wherein the at least one seal element is formed integrally on the insert element.

29. The washstand assembly as claimed in claim 27, wherein the sealing surface is provided by said wall, wherein the seal element is arranged at least in the region of an end side of the wall, wherein the seal element has a front-side sealing lip which substantially surrounds the run-off opening on the side of the interior space, and/or wherein the seal element is arranged in the region of an outer side of the wall and completely surrounds the wall in an encircling manner with at least one peripheral sealing lip.

30. The washstand assembly as claimed in claim 27, wherein the sealing surface is provided by said flange region, wherein the at least one seal element comes to lie between the flange region and the rear wall and/or the recess of the rear wall.

31. The washstand assembly as claimed in claim 18, wherein the insert element can be connected to the washstand by way of a materially bonded adhesive connection and/or a mechanical connection.

32. The washstand assembly as claimed in claim 31, wherein the mechanical connection is a screw and dowel connection; or wherein the mechanical connection is a clamping connection between the insert element and the interior space.

33. The washstand assembly as claimed in claim 18, wherein the run-off opening penetrates a side wall of the water basin, wherein the run-off opening extends away from a bottom region of the wash basin in the direction of said side wall, and/or wherein the run-off opening, with respect to a transverse direction of the water basin, is arranged centrally in the side wall.

34. The washstand assembly as claimed in claim 18, wherein the insert element and/or the rear wall of the washstand has at least one coding element which is configured in such a way that incorrect installation of the insert element can be prevented.

* * * * *